United States Patent [19]

Bernkrant

[11] 4,002,223

[45] Jan. 11, 1977

[54] TELESCOPING COLLAPSIBLE LADDER

[75] Inventor: Keith David Bernkrant, Miami, Fla.

[73] Assignee: Firearms Import and Export Corporation, Miami, Fla.

[22] Filed: Apr. 14, 1976

[21] Appl. No.: 677,044

[52] U.S. Cl. ..... 182/156; 182/206; 182/228

[51] Int. Cl.[2] ..... E06C 1/36

[58] Field of Search ..... 182/206, 195, 46, 228, 182/207, 156, 163

[56] References Cited

UNITED STATES PATENTS 3,653,463 4/1972 Neal ..... 182/195

3,858,683 1/1975 Rachocki ..... 182/206

*Primary Examiner*—Reinaldo P. Machado

*Attorney, Agent, or Firm*—Oltman and Flynn

[57] ABSTRACT

A ladder is disclosed which includes telescoping sections that collapse and extend for adjusting the length of the ladder. The ladder is particularly useful on boats and may have curved upper ends on its side members for hooking the ladder over the side of a boat. The curved ends are rotatable for collapsing them toward the major plane of the ladder. Rotatable stand-off legs are also provided.

7 Claims, 10 Drawing Figures

TELESCOPING COLLAPSIBLE LADDER

BACKGROUND OF THE INVENTION

Boat ladders which are at least partly collapsible have been proposed, for example, in U.S. Pat. No. 3,590,952. One advantage of a collapsible boat ladder is that in its collapsed condition it occupies less space which facilitates storage and shipment of the ladder. It is also desirable if the length of the ladder can be adjusted. Foldable ladders have been proposed in U.S. Pat. Nos. 1,603,638, 2,758,770, and 3,286,789. However, the construction of such ladders has been unduly complicated.

SUMMARY OF THE INVENTION

The present invention provides a boat ladder having telescoping sections which allow the length of the ladder to be adjusted. The telescoping sections are incorporated in the side members of the ladder, and there is a tubular female section and a male section in each side member which may be telescopically adjusted between collapsed and extended positions for adjusting the length of the ladder. Thus, the ladder may be collapsed for storage and shipment, and extended when in use. The side members may have curved upper ends forming hooks so that the ladder can be hooked over the side of an object such as a boat. Preferably, the hooks are rotatable so that they can be collapsed toward the major plane of the ladder. Stand-off legs may be provided, and these legs are also preferably rotatable so that they can be collapsed toward the major plane of the ladder.

Accordingly, it is an object of the present invention to provide an improved ladder which can be collapsed and extended for adjusting the length of the ladder.

Another object of the invention is to provide a ladder in which stand-off legs and hooks can be collapsed toward the major plane of the ladder.

A further object of the invention is to simplify the construction of a collapsible ladder to facilitate its manufacture on a volume production basis.

Other objects of this invention will appear from the following description and appended claims, reference being had to the accompanying drawings forming a part of this specification wherein like reference characters designate corresponding parts in the several views.

Figure 1:
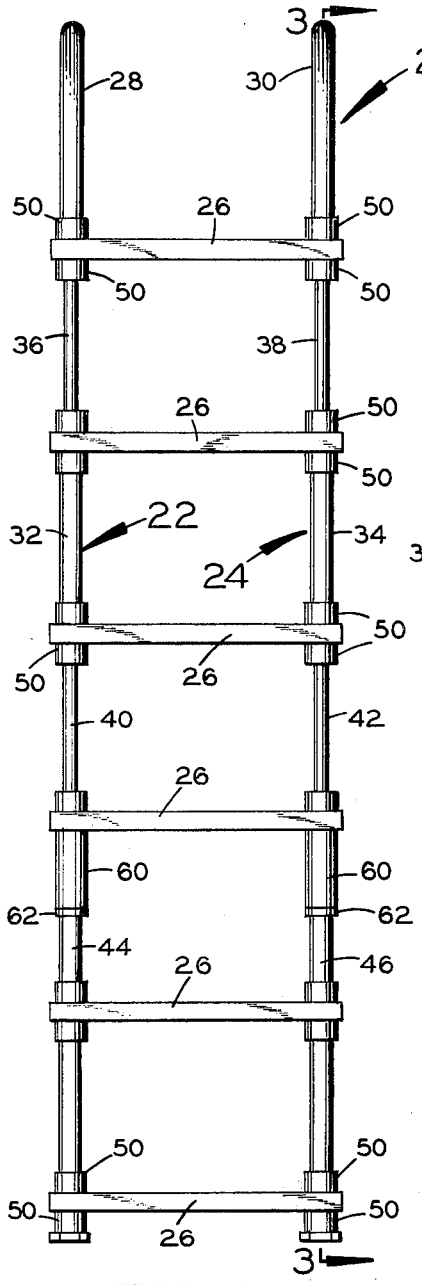
FIG. 1 is a front elevational view of a telescoping, collapsible ladder in accordance with one embodiment of the invention, the ladder being shown in an extended condition.
Figure 2:
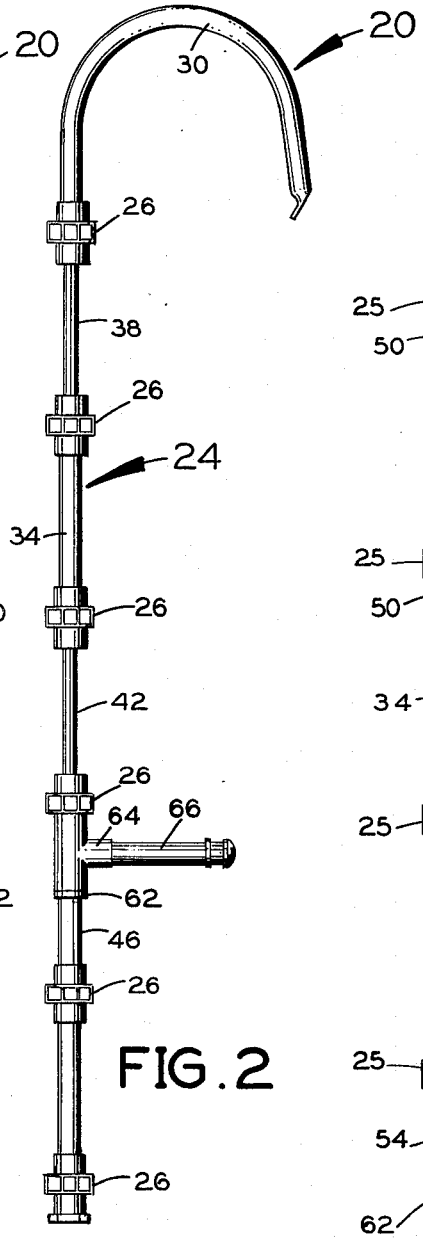
FIG. 2 is a side elevational view of the ladder of FIG. 1.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The ladder 20 includes two parallel side members designated generally 22 and 24 which are the legs of the ladder. There are a plurality of parallel steps 26 traversing the side members and affixed thereto. The steps 26 and the side members 22 and 24 lie in the major plane of the ladder. The upper end sections 28 and 30 of the ladder curve out of the major plane to form hooks for hooking the ladder over the side of an object such as a boat.

The side members 22 and 24 include tubular female sections 32 and 34 and male sections 36 and 38 which are in telescoping relation with the female sections 32 and 34 and collapsible and extendible with respect thereto. The side members 22 and 24 also include another pair of male sections 40 and 42 and female sections 44 and 46 also in telescoping relation. The telescoping male and female sections make it possible to adjust the length of the ladder. Thus, the ladder can be collapsed lengthwise for storage and shipment, and extended for use on the side of a boat.

It may be seen that the male and female sections alternate along the length of each side member. The male sections 42 and 38 are rigidly affixed as with cement to the adjoining female sections 34 and 30 respectively. Likewise, the male sections 40 and 36 are affixed with cement to the adjoining female sections 32 and 28 respectively. Both the male and female sections are preferably made of plastic pipe, and the plastic material is preferably polyvinyl chloride. The pipe can be made by a conventional extrusion process.

The male sections fit slidably inside the female sections with which they telescope. The side members 22 and 24 include joints at 25 between the telescoping male and female sections, and steps 26 are located at these joints. The lowest two steps are not at joints. There are sleeves 50 on both sides of each step except at 60. The sleeves 50 are rigidly affixed to the corresponding steps and male and female sections as with cement. Thus, the sleeves help to hold the steps in place. The steps are also affixed in place with cement.

Figure 3:
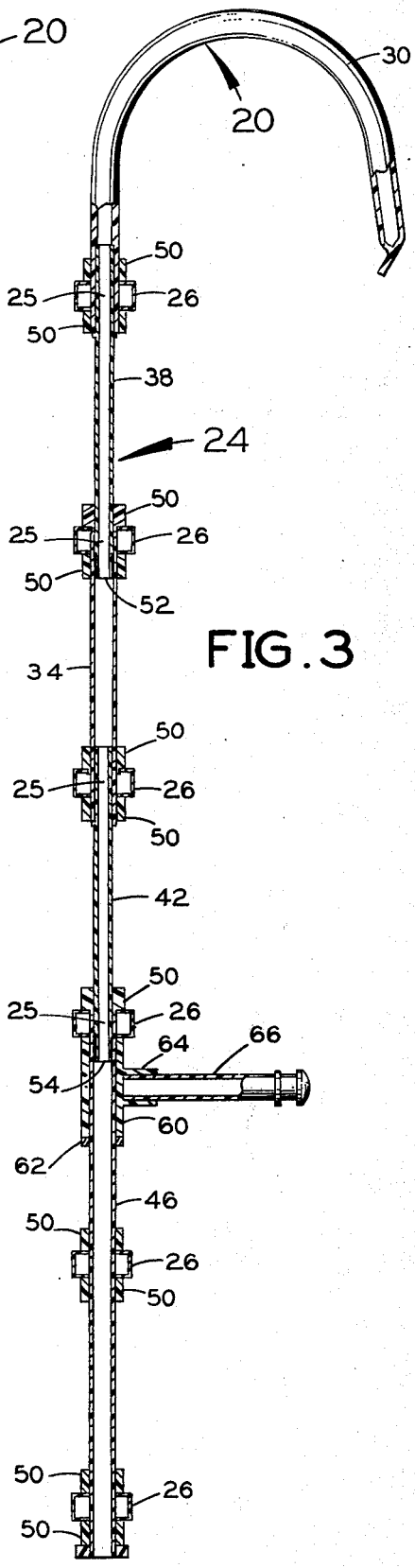
FIG. 3 is an enlarged vertical sectional view taken along line 3—3 of FIG. 1 and looking in the direction of the arrows.
Figure 4:
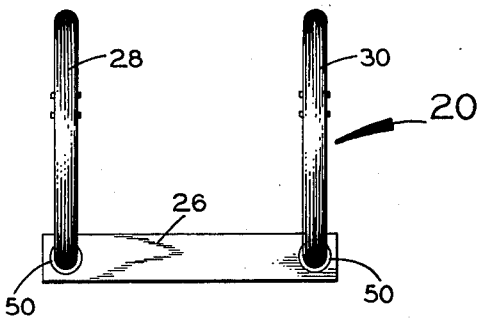
FIG. 4 is a top plan view of the ladder.
Figure 5:
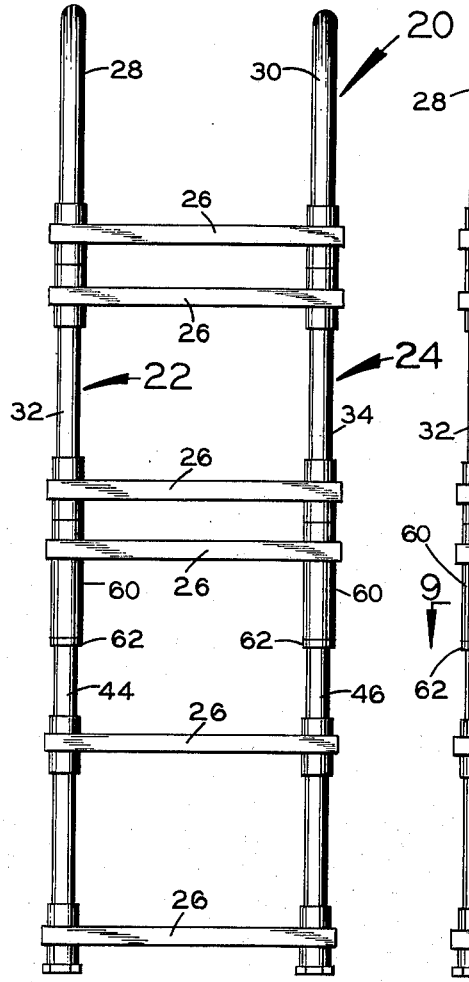
FIG. 5 is a front elevational view of the ladder when in a partially collapsed condition.
Figure 6:
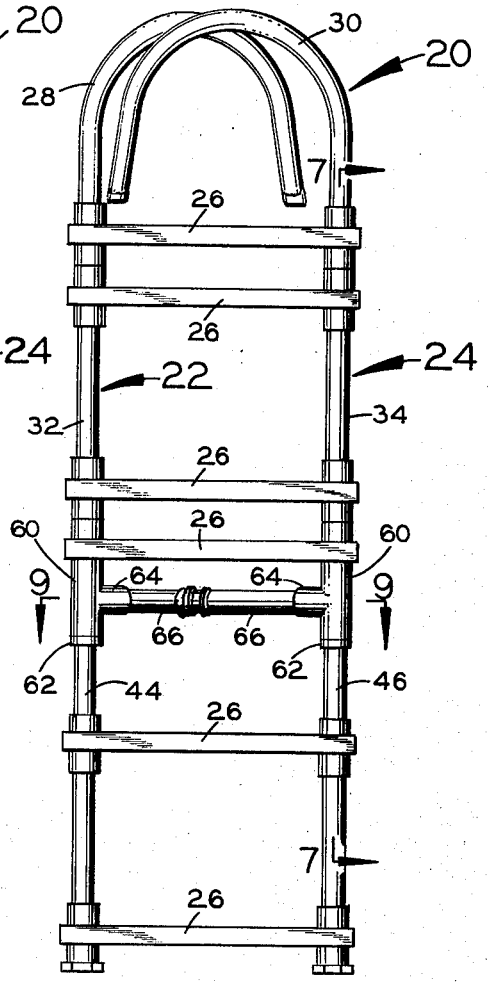
FIG. 6 is a front elevational view similar to FIG. 5, but showing the ladder in a fully collapsed condition.
Figure 7:
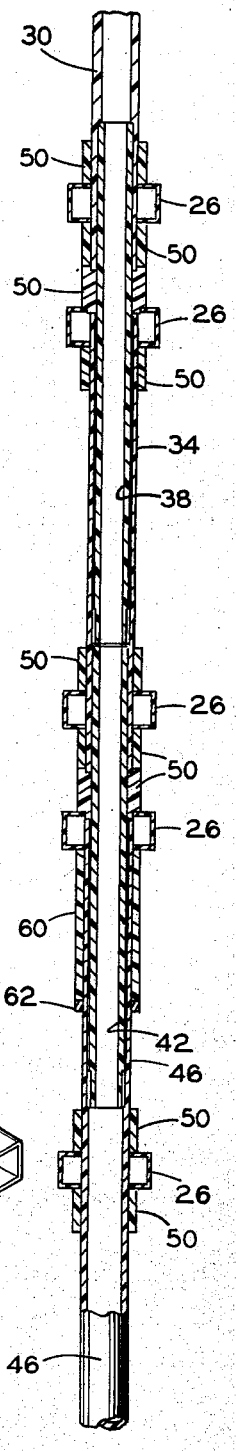
FIG. 7 is a vertical sectional view taken along line 7—7 of FIG. 6 and looking in the direction of the arrows.

As shown in FIG. 3, the male sections 36, 38, 40 and 42 have enlarged rings such as 52 and 54 at their lower ends. The upper sleeve 50 of each pair forms a stop for the enlarged rings 52 and 54 so that the male sections cannot be pulled out of the female sections once the ladder has been assembled.

Figure 9:
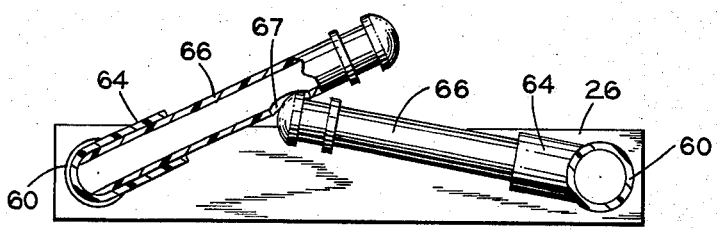
FIG. 9 is an enlarged top plan view similar to FIG. 8, but showing a portion of the ladder in section to reveal the internal construction.

Each of the steps 26 is a hollow plastic extrusion having apertures 56 and 58 at opposite ends thereof which receive the respective section on which the step is mounted. The sleeves 60 are longer than the sleeves 50 and they are rotatable on the female sections 44 and 46. There are rings 62 affixed to the female sections 44 and 46 to hold the rotatable sleeves 60 in place longitudinally. The sleeves 60 have hollow projections 64 which receive stand-off legs 66. When the sleeves 60 are rotated, the stand-off legs can be collapsed toward the major plane of the ladder to the positions shown in FIG. 9. Both of the stand-off legs are made of plastic pipe, and one of the stand-off legs (the left one as viewed in FIG. 9) has an opening 67 which receives the end of the other stand-off leg when the stand-off legs are collapsed to the position shown in FIG. 9.

Figure 8:
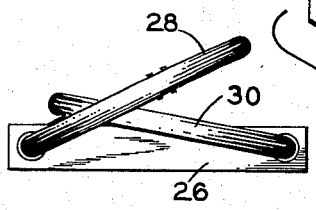
FIG. 8 is a top plan view of FIG. 6.
Figure 10:
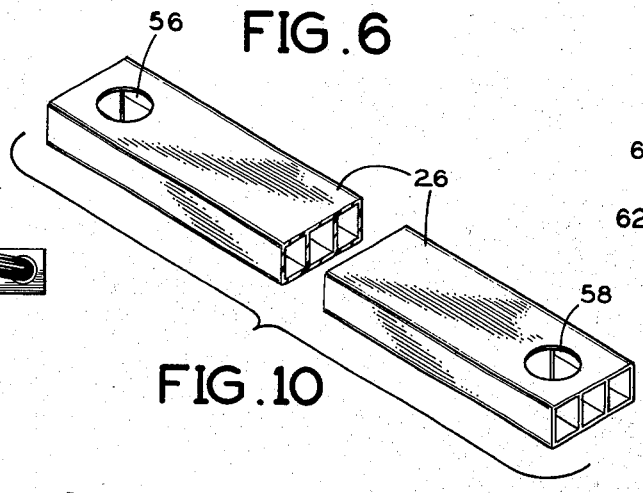
FIG. 10 is a perspective view of one of the steps of the ladder.

The upper end sections 28 and 30 are also rotatable so that they can be collapsed toward the major plane of the ladder to the positions shown in FIG. 8. Thus, when the ladder is collapsed both lengthwise and toward its major plane, it occupies relatively little space for shipment and storage purposes.

Having thus described my invention, I claim:

1. In a ladder comprising parallel side members and a plurality of parallel steps traversing said side members and affixed thereto, said ladder having a major plane, the improvements wherein:

said side members each include a tubular female section and a male section in concentric, telescoping relation with said female section and collapsible and extendable with respect thereto;

said male and female sections each comprising plastic pipe with said male sections fitting slidably inside said female sections;

said side members each further including additional male and female telescoping sections of plastic pipe alternating along the length of said ladder;

said side members further including joints between said male and female sections; and sleeves at said joints arranged in pairs embracing said steps;

said male sections having enlarged ends; and one of said sleeves in each pair forming a stop for one of said enlarged ends;

whereby said side members of said ladder may be telescopically adjusted between collapsed and extended positions for adjusting the length of said ladder.

2. The ladder as claimed in claim 1 wherein:

said steps each comprise a plastic extrusion having apertures at opposite ends thereof receiving respective female sections.

3. The ladder as claimed in claim 2 wherein:

one end of each of said male sections is rigidly affixed to an adjoining female section other than the one with which said male section telescopes.

4. The ladder as claimed in claim 1 wherein:

one of said sleeves on each of said side members is rotatable and has a stand-off leg affixed thereto;

said stand-off legs being collapsible toward the major plane of said ladder.

5. The ladder as claimed in claim 4 wherein:

one of said stand-off legs has an opening for receiving an end of the other stand-off leg when said legs are collapsed.

6. The ladder as claimed in claim 1 wherein:

a pair of said female sections at the upper end of said ladder are curved to form hooks for hooking said ladder over the side of a boat.

7. The ladder as claimed in claim 6 wherein:

said hooks are rotatable for collapsing the same toward the major plane of said ladder.

* * * * *